US010280815B2

(12) United States Patent
Bayrakdar

(10) Patent No.: US 10,280,815 B2
(45) Date of Patent: May 7, 2019

(54) CAMSHAFT ADJUSTER LINK TO A DOUBLE CAMSHAFT

(71) Applicant: Schaeffler Technologies AG & Co. KG, Herzogenaurach (DE)

(72) Inventor: Ali Bayrakdar, Roethenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 15/535,950

(22) PCT Filed: Nov. 26, 2015

(86) PCT No.: PCT/DE2015/200519
§ 371 (c)(1),
(2) Date: Aug. 17, 2017

(87) PCT Pub. No.: WO2016/110281
PCT Pub. Date: Jul. 14, 2016

(65) Prior Publication Data

US 2018/0171833 A1 Jun. 21, 2018

(30) Foreign Application Priority Data

Jan. 8, 2015 (DE) ..... 10 2015 200 139

(51) Int. Cl.
*F01L 1/34* (2006.01)
*F01L 1/047* (2006.01)
*F01L 1/344* (2006.01)

(52) U.S. Cl.
CPC ..... *F01L 1/3442* (2013.01); *F01L 1/047* (2013.01); *F01L 2001/0473* (2013.01); *F01L 2001/054* (2013.01); *F01L 2001/34433* (2013.01)

(58) Field of Classification Search
CPC ..... F01L 1/3442; F01L 1/047; F01L 2001/34433; F01L 2001/0473; F01L 2001/054
See application file for complete search history.

(56) References Cited

U.S. PATENT DOCUMENTS 7,287,499 B2 10/2007 Lawrence et al.
7,610,890 B2 11/2009 Lettmann et al.
(Continued)

FOREIGN PATENT DOCUMENTS

DE 102005014680 8/2006
DE 602006000050 4/2008
(Continued)

OTHER PUBLICATIONS

International Search Report of PCT/DE2015/200519, dated Apr. 1, 2016, 3 pages.

*Primary Examiner* — Mark A Laurenzi
*Assistant Examiner* — Wesley G Harris
(74) *Attorney, Agent, or Firm* — Davidson, Davidson & Kappel, LLC

(57) ABSTRACT

A hydraulic camshaft adjuster (1) of the vane cell type is provided, including: a stator (4) that is set up for non-rotatable connection to an inner shaft (2) of a double camshaft (3), wherein a connecting element (5) for non-rotatable accommodation of the inner shaft (2) is accommodated in the stator (4) in a form-locking manner; and including a rotor (7) which is rotatable relative to the stator (4) and which is set up for non-rotatable connection to an outer shaft (6) of the double camshaft (3), wherein the connecting element (5) is accommodated in the stator (4) with clearance for compensating axial tolerances and/or a relative tilting of the shafts (2, 6) in an operating state of the
(Continued)

camshaft adjuster (1). A valve drive unit (11) including such a camshaft adjuster (1) is also provided.

17 Claims, 5 Drawing Sheets

(56) References Cited

U.S. PATENT DOCUMENTS

| | | | | |
|---|---|---|---|---|
| 8,122,863 | B2 | 2/2012 | Myers | |
| 9,316,127 | B2 | 4/2016 | Elfers | |
| 9,366,159 | B2 | 6/2016 | Wigsten et al. | |
| 2006/0185471 | A1* | 8/2006 | Lawrence | F01L 1/047 74/595 |
| 2007/0119402 | A1* | 5/2007 | Lancefield | F01L 1/022 123/90.17 |
| 2008/0184950 | A1* | 8/2008 | Lawrence | F01L 1/047 123/90.17 |

FOREIGN PATENT DOCUMENTS

| | | | | |
|---|---|---|---|---|
| DE | 102008023098 | | 12/2009 | |
| DE | 102009041873 | | 4/2010 | |
| DE | 102011076852 | | 11/2012 | |
| DE | 102011078818 | | 1/2013 | |
| DE | 102011120815 | | 6/2013 | |
| DE | 112012001009 | | 11/2013 | |
| DE | 102012105284 | | 12/2013 | |
| DE | 102015205770 | A1 * | 10/2016 | F01L 1/3442 |

* cited by examiner

CAMSHAFT ADJUSTER LINK TO A DOUBLE CAMSHAFT

The present invention relates to a hydraulic camshaft adjuster of the vane cell type/vane cell design for a valve train unit of an internal combustion engine, such as a gasoline engine or diesel engine, of a motor vehicle such as a passenger vehicle, truck, bus, or agricultural utility vehicle, including a stator that is provided for rotatably fixed connection to an inner shaft and a double camshaft, a connecting element for rotatably fixed accommodation of the inner shaft being accommodated in the stator in a form-locked manner, and including a rotor that is rotatable relative to this stator and provided for rotatably fixed connection to an outer shaft of the double camshaft. Moreover, the present invention relates to a valve train unit that includes such a camshaft adjuster. Such valve train units are also known as VCT cam-in-cam systems (i.e., variable camshaft adjuster systems having a double-shaft (shaft-in-shaft) camshaft).

BACKGROUND

Valve train units that include double-shaft camshafts, as well as camshaft adjusters for these valve train units, are also known from the prior art. For example, DE 10 2008 023 098 A1 provides a double pivotably rotatable camshaft adjuster in a layered design, and a valve train assembly of an internal combustion engine with a camshaft and this type of camshaft adjuster, for changing the relative position of the camshaft with respect to a second shaft, such as a crankshaft or drive shaft. The camshaft adjuster, as a rotary component, includes at least one rotor and one stator, which between them enclose hydraulic chambers with changeable, in particular oppositely directed, volumes. At least one of the rotary components is connected to the camshaft, via a pin that engages with the camshaft, in such a way that changes in position of the rotor with respect to the stator are transmitted via the pin to the camshaft.

In other words, adjusters/camshaft adjusters are thus already known whose stator is driven by a gearwheel and supported on the inner camshaft, and fixedly mounted via a rotor. However, with some designs it has proven disadvantageous that the inner camshaft (inner shaft) is generally relatively difficult to center and to support, since the inner camshaft is usually supported by the connecting element, designed as a transverse pin, via the outer cam. For these reasons, it is not possible to manufacture the inner camshaft with great precision. This is disadvantageous in particular for designs in which the gearwheel is provided above the adjuster, and in addition gearwheel runout tolerances must be taken into consideration for the required function. In known approaches such as in DE 10 2011 120 815 A1, even two gearwheels are thus necessary, which, however, in turn adversely affect the number of components and the manufacturing costs for the camshaft adjuster and the valve train assembly/valve train unit. In addition, manufacturing the camshaft end in each case, in particular the inner shaft (by expansion), is relatively complicated.

Further prior art is also known from DE 10 2011 078 818 A1.

SUMMARY OF THE INVENTION

It is an object of the present invention to eliminate these disadvantages known from the prior art and to provide a camshaft adjuster in which, for use on a double camshaft, an adjustment function is ensured preferably in any operating state; in particular, the aim is to reduce the tendency of the camshaft adjuster to jam.

The present invention provides that the connecting element is accommodated in the stator with play in order to compensate for axial tolerances and/or relative tilting of the shafts relative to one another in an operating state of the camshaft adjuster.

Due to this accommodation with play, the risk of jamming between the two shafts of the double camshaft, and thus between the stator and the rotor, is greatly reduced. In particular, the stator may be displaced or tilted relative to the camshaft/the two shafts of the camshaft by a certain degree of free play.

Further advantageous specific embodiments are explained in greater detail below.

Accordingly, it is also advantageous when the connecting element has a pin-shaped/bolt-shaped design (i.e., is designed as a fastening pin/bolt), or a further component is present there, for example at the location between a component, fixed to the stator, and the connecting element. A particularly stable connecting element is thus provided which is easily insertable into through holes of the particular inner shaft and outer shaft. The design of the camshaft adjuster and of the valve train unit is further simplified.

In this regard, if the connecting element is accommodated/accommodated in a form-locked manner in a drive gearwheel of the stator, a particularly direct transmission of force is implemented. In the operating state of the camshaft adjuster, the drive gearwheel is further rotatably fixedly connected to a crankshaft, and preferably directly meshes with a gearwheel that is rotatably fixedly connected to the crankshaft, or preferably is rotatably fixedly connected to the gearwheel of the crankshaft with the aid of a continuous traction mechanism of a traction drive. The efficiency of the system is further improved in this way.

If the connecting element is accommodated/accommodated in a form-locked manner/engaged on two accommodation areas of the stator that are provided in the form of grooves, i.e., groove-shaped, the number of components is further reduced and the manufacturing costs may be further lowered. Two accommodation areas, each of which accommodates an end area of the one connecting element, are particularly preferably situated radially outside the outer shaft.

It is also advantageous when the connecting element is accommodated in the stator with play in the radial direction of the stator and/or in the axial direction of the stator. The risk of jamming is further reduced in this way.

Furthermore, the present invention also includes a valve train unit/a valve train assembly with a camshaft adjuster according to one of the specific embodiments described above, and with a double camshaft that includes an outer shaft and an inner shaft that is situated radially within this outer shaft and rotatable relative to the outer shaft, a stator of the camshaft adjuster being connected to the inner shaft in a form-locked manner with the aid of a connecting element for the rotatably fixed connection, and a rotor of the camshaft adjuster being rotatably fixedly connected to the outer shaft. A valve train unit thus likewise has a particularly efficient design.

In this regard, it is also advantageous when the rotor is rotatably fixedly pressed onto the outer shaft/fastened to the outer shaft on the front side with the aid of a fastening means designed as a screw or as a central valve (a central valve screw, for example). In this way, the outer shaft is modified with preferably little complexity for the connection to the rotor/the camshaft adjuster. For example, it is sufficient here to provide a female thread, with which the fastening means engages via a male thread, on an inner circumferential surface of the outer shaft. A particularly strong connection between the rotor and the outer shaft is implemented in this way.

Moreover, it is also advantageous when the connecting element passes through the outer shaft (preferably with play) and the inner shaft (preferably with no play, for example via a sliding fit or a press fit). The connecting element more preferably passes through the outer shaft and the inner shaft in the radial direction. A particularly compact design is implemented in this way. The connecting element is more preferably placed/accommodated in the outer shaft with play in particular in the circumferential direction and in the axial direction of the camshaft. The risk of jamming is further reduced in this way.

It is also advantageous when the connecting element is accommodated with play in an axial accommodation space, the accommodation space being delimited toward a first axial side by the stator, and being delimited with respect to a second axial side opposite from the first side with the aid of a stop element that is fastened to the outer shaft. Secure accommodation of the connecting element is implemented in this way.

The stop element is particularly preferably designed as a lock washer which is rotatably fixedly mounted on the outer circumferential side of the outer shaft.

Furthermore, it is also advantageous when multiple sealing elements are situated in a radial space between the inner shaft and the outer shaft in order to seal off the interior of the outer shaft via two through holes through which the connecting element protrudes. Particularly efficient sealing is implemented in this way. In addition, it is advantageous when the two through holes in the outer shaft are each designed as elongated holes that extend in the longitudinal direction along a circumference of the outer shaft. The relative rotation between the outer shaft and the inner shaft is thus implementable in a particularly simple manner.

In other words, a VCT cam-in-cam system is thus implemented as a valve train unit in which a drive wheel (drive gearwheel of the stator) is connected to the inner camshaft (inner shaft) with the aid of a bolt (connecting element), the bolt-wheel connection having play in order to compensate for axial tolerances and tilting between the two shafts (outer shaft and inner shaft) of the double camshaft, without jamming effects occurring in the process. Although the connection should effectuate a certain measure of play or tolerance compensation (in particular for compensating for concentricity errors), on the other hand the torque transmission from the inner shaft to the stator should preferably be kept free of play. Otherwise, a back-and-forth impact could occur due to the alternating torque. Therefore, an element is conceivable which absorbs the play between the connecting element and the stator or the gearwheel, or the accommodation part in the circumferential direction.

BRIEF DESCRIPTION OF THE DRAWINGS

The present invention is explained in greater detail below with reference to exemplary embodiments illustrated in the figures.

DETAILED DESCRIPTION

Figure 1:
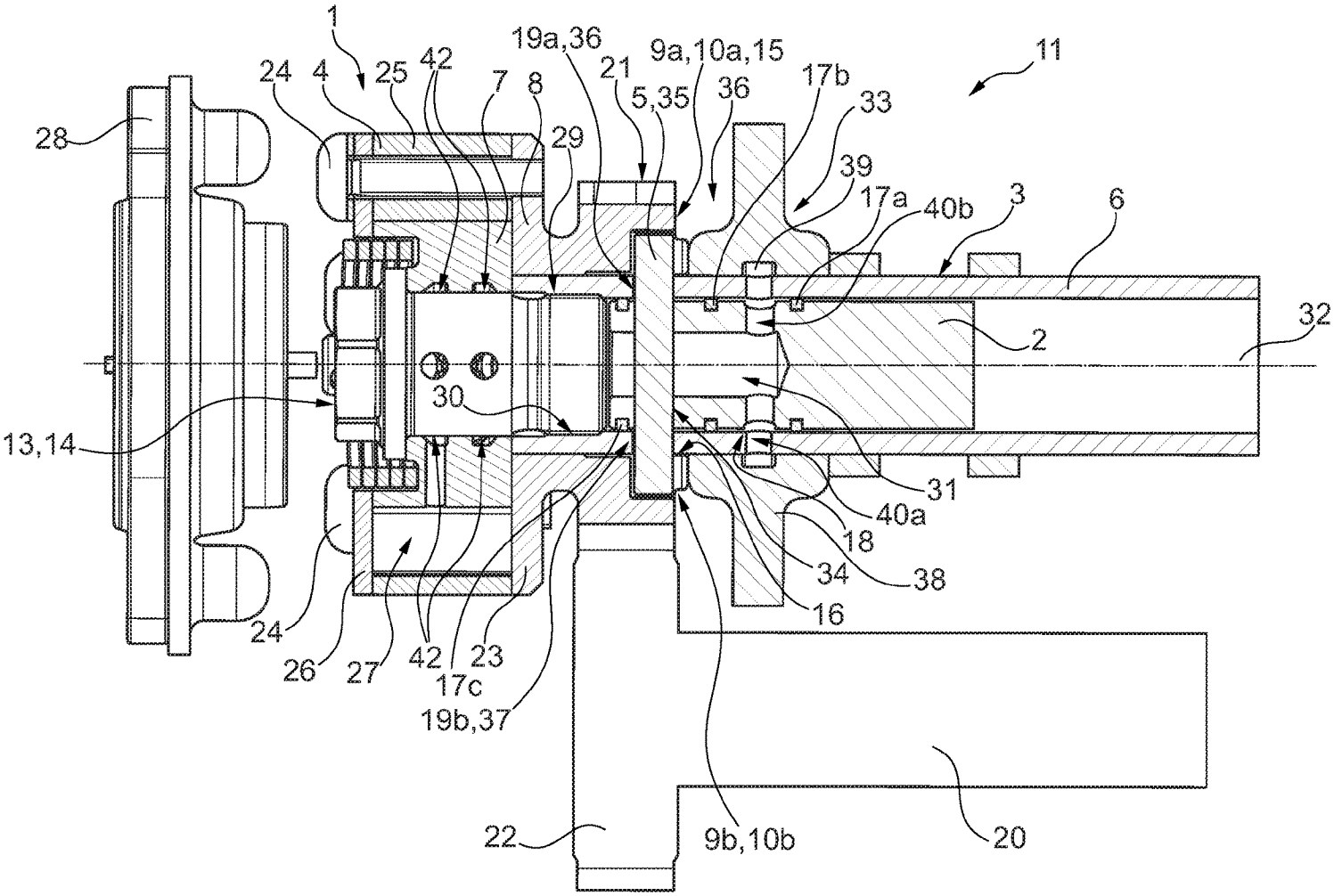
FIG. 1 shows a longitudinal sectional illustration of a valve train unit according to the present invention, together with a camshaft adjuster according to the present invention, according to a first specific embodiment, the camshaft adjuster and the valve train unit being sectioned in a plane in which the rotation axis of a double camshaft of the valve train unit extends.

The figures are merely schematic, and are used only for an understanding of the present invention. Identical elements are provided with the same reference numerals. The various features of the various specific embodiments may be combined with one another.

In FIG. 1, camshaft adjuster 1 according to the present invention according to a first specific embodiment is inserted/mounted in a valve train unit 11 according to the present invention, which likewise is designed according to a first specific embodiment. Camshaft adjuster 1 functions or is designed as a hydraulic camshaft adjuster 1 of the vane cell type/vane cell design. In addition, valve train unit 11 is a valve train unit 11 of an internal combustion engine for controlling multiple intake valves and exhaust valves of the particular combustion chamber of the internal combustion engine, which are not illustrated here for the sake of clarity. Valve train unit 11 includes, in addition to camshaft adjuster 1, a camshaft designed as a double camshaft 3 (also referred to as a cam-in-cam camshaft or shaft-in-shaft camshaft). As described in greater detail below, this double camshaft 3 includes a hollow tubular outer shaft 6 and an inner shaft 2 situated radially within outer shaft 6.

Camshaft adjuster 1 includes a stator 4 having a housing-like design. Stator 4 in turn includes a stator base body 25 which has an essentially cylindrical design and extends in the axial direction of rotation axis 32 of camshaft adjuster 1 (i.e., the rotation axis of double camshaft 3 during operation/in the operating state). A drive gearwheel 8 is rotatably fixedly connected to stator base body 25. Drive gearwheel 8 includes external teeth 21 which in the illustrated operating state/assembled state directly mesh with a gearwheel 22 that is rotatably fixedly connected to drive shaft 20 (in the present case, the crankshaft of the internal combustion engine). However, according to another specific embodiment it is alternatively possible to rotatably fixedly connect drive gearwheel 8 to drive shaft 20 with the aid of a continuous traction mechanism such as a chain or a belt of a traction drive, for example a chain drive or belt drive.

According to the first specific embodiment, drive gearwheel 8 includes a disk-shaped flange section 23 which is axially offset with respect to its external teeth 21, and which at the same time forms an axial cover of the interior of stator 4. This flange section 23 is rotatably fixedly connected to stator base body 25 with the aid of fastening means 24. Stator base body 25 extends away, in the axial direction, from a side of flange section 23 facing away from external teeth 21. In turn, an end cover 26 is fastened to stator base body 25, likewise with the aid of fastening means 24 here, at an axial front side of stator base body 25 facing away from flange section 23.

Rotor 7 is rotatably supported relative to stator 4 radially within base body 25, which extends continuously along a circumference (with regard to rotation axis 32). Rotor 7 is thus rotatably supported in the interior of stator 4. According to the design of hydraulic camshaft adjuster 1 of the vane cell type, as already known from the prior art, multiple hydraulic working chambers 27 are distributed along the circumference between rotor 7 and stator 4, namely, radially between stator base body 25 and rotor 7. Rotor 7 is adjustable relative to stator 4 between an advanced position and a retarded position as a function of the pressure acting on these working chambers 27. Working chambers 27 are each sealed off from the surroundings in the axial direction by end cover 26 and flange section 23/drive gearwheel 8.

Rotor 7 has a central through hole which in the operating state is situated concentrically with respect to rotation axis 32 of rotor 7, which corresponds to rotation axis 32 of camshaft adjuster 1 and of stator 4. A fastening means 14, which in the first specific embodiment is designed here as a central valve 13/*a* central valve screw 13, is provided for fastening rotor 7 to double camshaft 3. This central valve 13 is designed in such a way that it allows hydraulic medium to be introduced into or discharged from working chambers 27 as a function of an adjustment actuator 28 that acts on the central valve. Fastening means 14 has an external tooth section 29 that is screwed/turned into an internal tooth section 30 of outer shaft 6 of double camshaft 3. In the operating state, rotor 7 is thus pressed onto the front side of outer shaft 6 and rotatably fixedly connected to same.

The further design of double camshaft 3 is likewise particularly clearly apparent in FIG. 1. Outer shaft 6 is designed as a first shaft of double camshaft 3 and is formed in the shape of a hollow shaft, i.e., is tubular. In turn, inner shaft 2 is supported/accommodated radially within this outer shaft 6 so that it is rotatable relative to outer shaft 6. In this specific embodiment, inner shaft 2 and outer shaft 6 in each case are not illustrated completely along their axial length, but, rather, only in sections on the part of camshaft adjuster 1. Outer shaft 6 and inner shaft 2, which are not illustrated in greater detail here for the sake of clarity, are each rotatably fixedly connected to a group of cams. Outer shaft 6 (as the exhaust camshaft) is preferably rotatably fixedly connected to a group of exhaust valve cams, and inner shaft 2 (as the intake camshaft) is rotatably fixedly connected to a group of intake valve cams. According to another specific embodiment, if outer shaft 6 (as the intake camshaft) is rotatably fixedly connected to a group of intake valve cams, inner shaft 2 (as the exhaust camshaft) is rotatably fixedly connected to a group of exhaust valve cams. In addition, inner shaft 2 is essentially designed as a solid shaft. The inner shaft, in its front side facing central valve 13, has a blind hole 31 that extends concentrically with respect to rotation axis 32 of double camshaft 3 and of camshaft adjuster 1. As explained in greater detail below, this blind hole 31 is used as part of a hydraulic medium supply system 33.

While rotor 7, as already described, is rotatably fixedly connected to outer shaft 6, stator 4 is rotatably fixedly connected to inner shaft 2 via drive gearwheel 8. For this purpose, inner shaft 2 has a receiving hole 34 that passes through the inner shaft in the radial direction (along a radial line with respect to rotation axis 32). This receiving hole 34 completely passes through inner shaft 2 in its radial direction. Receiving hole 34 is formed by a continuous through hole. This receiving hole 34 is introduced into inner shaft 2 in an axial area in which blind hole 31 also extends. As a result, receiving hole 34 and blind hole 31 intersect essentially perpendicularly. Due to this intersection, receiving hole 34 is divided into two partial holes, which, however, are regarded as a single receiving hole 34 in the following discussion. Receiving hole 34 extends perpendicularly with respect to rotation axis 32 (viewed in the assembled state).

A connecting element 5 according to the present invention is inserted into this receiving hole 34, this connecting element 5 being rotatably fixedly connected to inner shaft 2. Connecting element 5 is designed as a bolt/pin. Connecting element 5 is designed as a solid bolt 35 in this specific embodiment. Solid bolt 35 has a circular cross section. In FIG. 1, this solid bolt 35 is illustrated extending in the plane of the drawing and being inserted into receiving hole 34 perpendicularly with respect to rotation axis 32. Solid bolt 35 is fastened in receiving hole 34 with a press fit.

In addition, solid bolt 35 protrudes through two through holes 19*a*, 19*b* in outer shaft 6 at each of two radially opposite exit sides of receiving hole 34. Each of through holes 19*a*, 19*b* is designed in the shape of an elongated hole. A first through hole 19*a* is provided on a first circumferential side 36 of outer shaft 6, oriented as the top side in FIG. 1. In turn, second through hole 19*b* is situated on a second circumferential side 37, which is offset by 180° with respect to first circumferential side 36. Each of through holes 19*a*, 19*b* is designed as an elongated hole. The elongated hole is designed as a continuous hole, i.e., passing through outer shaft 6 in the radial direction, and extends in the longitudinal direction of the elongated hole in a radial plane of outer shaft 6 along a certain circumferential area of outer shaft 6. The two through holes 19*a* and 19*b* are offset by 180° relative to one another along a circumferential line of the outer shaft, and are separate from one another. Connecting element 5 is thus movable along these elongated holes as a function of the position of inner shaft 2 relative to outer shaft 6.

Through holes 19*a* and 19*b* each extend in such a way that solid bolt 35 passes through them with play in the axial direction and also with respect to the rotation direction. A rotation of inner shaft 2 relative to outer shaft 6 is thus made possible in an angular area that is determined by the longitudinal extension of through holes 19*a* and 19*b*.

Connecting element 5 in turn protrudes into stator 4 in the radial direction at a radial outer side of outer shaft 6, namely, on first circumferential side 36 and on second circumferential side 37. At these locations, connecting element 5 is accommodated with play in stator 4 in at least one operating state of camshaft adjuster 1 in order to compensate for axial tolerances and/or relative tilting of the two shafts 2 and 6. For this purpose, connecting element 5 is inserted/accommodated with play in drive gearwheel 8 in the radial direction, in the circumferential direction, and in the axial direction. On first circumferential side 36, connecting element 5 is positioned/protrudes with a first end area in a first accommodation area 9*a* with play in the axial direction, the radial direction, and the circumferential direction of camshaft adjuster 1. In turn, a second accommodation area 9*b* is formed on second circumferential side 37 and accommodates a second end area of connecting element 5, situated opposite from the first end area, with play in the axial direction, the radial direction, and the circumferential direction of camshaft adjuster 1. First accommodation area 9*a* has the same design as second accommodation area 9*b*. As a result of this accommodation with play, inner shaft 2 is tiltable/adjustable relative to outer shaft 6 about a certain angular area without the possibility of connecting element 5, and thus the two shafts 2, 6 of camshaft 3, jamming. First accommodation area 9*a* and second accommodation area 9*b* are designed as grooves 10*a*, 10*b*/end-face grooves that are introduced into the front side of drive gearwheel 8. First groove 10*a* and second groove 10*b* are introduced/formed on a front side of drive gearwheel 8 facing away from stator base body 25.

A stop element 16 which results in axial securing of connecting element 5 is situated on an axial side of drive gearwheel 8 facing away from stator base body 25. Connecting element 5 is movable with play in an axial accommodation space 15, a first axial side being formed by a front surface of drive gearwheel 8, and an oppositely situated second axial side of accommodation space 15 being formed by stop element 16. Axial displacement of connecting element 5 is delimited in this way. Connecting element 5 is accommodated with play in stator 4 and movably oriented/situated relative to outer shaft 6 (namely, with respect to through holes 19*a*, 19*b* introduced therein) in such a way that axial tolerances (in particular dimensional tolerances on drive gearwheel 8 and shafts 2, 6) and/or relative tilting of shafts 2, 6 with respect to one another are/is compensated for without jamming.

Moreover, in addition to stop element 16, a hydraulic medium supply bushing is rotatably fixedly fastened to an outer circumferential side of outer shaft 6, on an axial side facing away from stator base body 25. Hydraulic medium supply bushing 38 rests with its inner side, i.e., its radial inner side, securely on outer shaft 6, in particular rotatably fixedly on outer shaft 6. Hydraulic medium supply bushing 38 is part of hydraulic medium supply system 33. Hydraulic medium supply bushing 38 includes a supply channel 39. This supply channel 39 on the one hand is connected to a hydraulic supply, and on the other hand opens into supply boreholes 40 which pass through double camshaft 3, i.e., inner shaft 2 and outer shaft 6, in the radial direction. Hydraulic medium is supplied from hydraulic medium supply bushing 38 into the interior of outer shaft 6 via a first supply borehole 40*a* that passes through outer shaft 6 in the radial direction. Hydraulic medium is then further conducted to blind hole 31 via a second supply borehole 40*b*, which is provided in inner shaft 2 and likewise extends radially. Second supply borehole 40*b* is flush, i.e., in alignment, with first supply borehole 40*a*. Second supply borehole 40 also extends in the radial direction, and thus intersects with blind hole 31 in an axial area that is offset with respect to receiving hole 34.

Thus, for supplying hydraulic medium, after passing through first supply borehole 40*a*, hydraulic medium is supplied to second supply borehole 40*b*, and from there fed further to blind hole 31. From this blind hole 31, the hydraulic medium is then supplied to central valve 13. A hydraulic supply of central valve 13 is provided in this way. The diameter of blind hole 31 is larger than that of receiving hole 34, and thus also larger than that of solid bolt 35, so that although solid bolt 35 protrudes through blind hole 31, the hydraulic medium passes by solid bolt 35, to the side of the solid bolt in the axial direction.

A sealing device is provided in a radial space 18 between inner shaft 2 and outer shaft 6 for sealing off hydraulic medium supply system 33. A first sealing element 17*a*, which has an essentially ring-shaped design and is held in a form-locked manner in an annularly surrounding first circumferential groove on an outer side of inner shaft 2, seals off space 18 with respect to an axial side of supply boreholes 40*a* and 40*b* facing away from camshaft adjuster 1. These supply boreholes 40*a* and 40*b* are sealed off with respect to an axial side of supply boreholes 40*a* and 40*b* facing away from camshaft adjuster 1 with the aid of a second sealing element 17*b*. This second sealing element 17*b* is likewise situated on a ring-shaped second circumferential groove on the outer circumferential side of inner shaft 2, in parallel to the first circumferential groove. Second sealing element 17*b* is positioned in the axial direction between supply boreholes 40*a* and 40*b* and receiving hole 34 or through holes 19*a* and 19*b*. Second sealing element 17*b* thus prevents hydraulic medium from escaping from the space in the direction of through holes 19*a* and 19*b*. Yet another sealing element, referred to below as third sealing element 17*c*, is mounted on inner shaft 2 on an axial side of connecting element 5 facing rotor 7. This third sealing element 17*c* also has a ring-shaped design, and is held in a third circumferential groove in inner shaft 2 which extends in parallel to the first circumferential groove. This third sealing element 17*c* is used once again for sealing off space 18 on the part of central valve 13 toward through holes 19*a* and 19*b*. In particular second and third sealing elements 17*b* and 17*c*, which are inserted into radial space 18 between inner shaft 2 and outer shaft 6, are thus used for sealing off the interior of outer shaft 6 relative to or with respect to the two through holes 19*a* and 19*b*.

Figure 2:
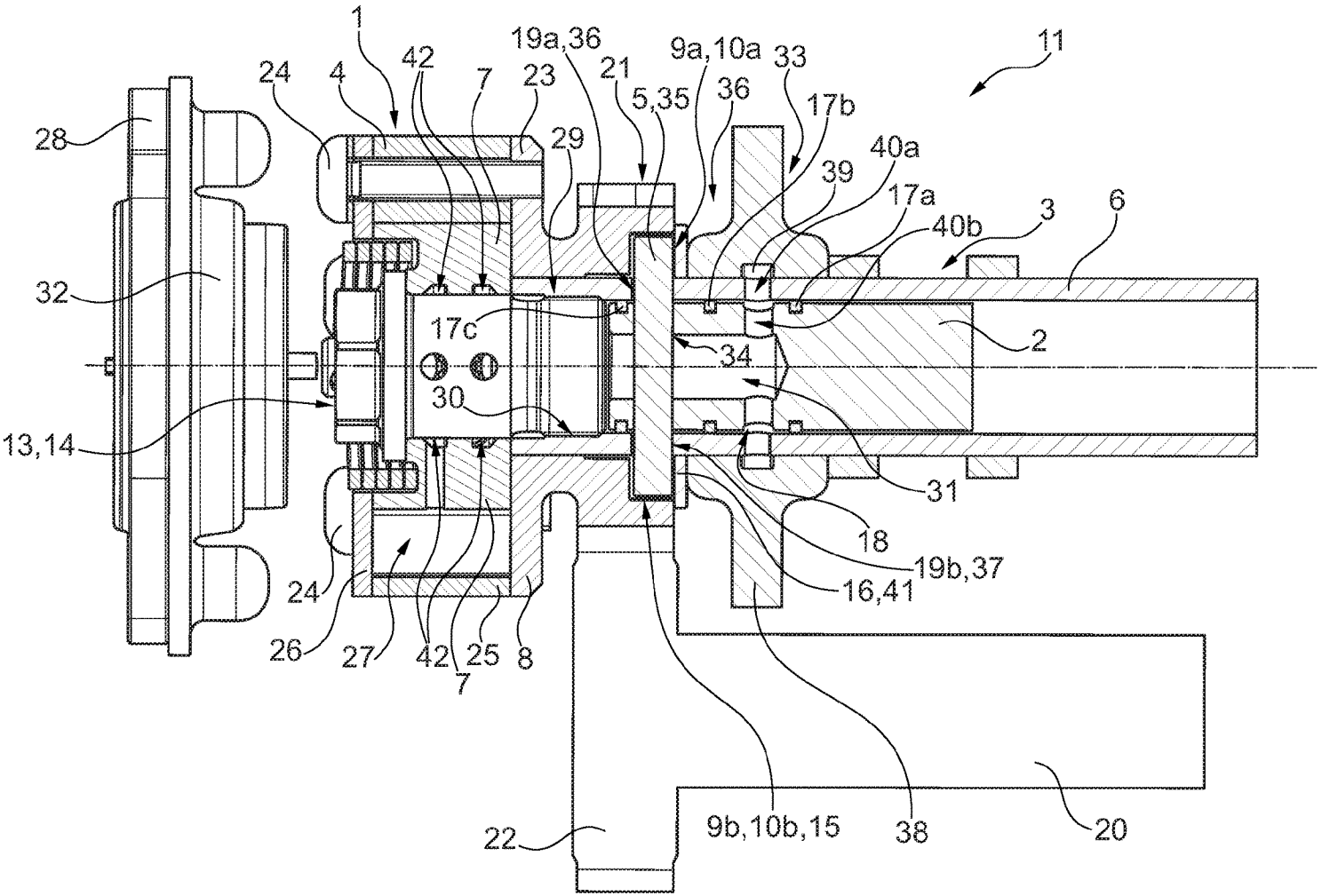
FIG. 2 shows a longitudinal sectional illustration of a valve train unit according to the present invention, together with a camshaft adjuster according to the present invention, according to a second specific embodiment which is designed and depicted essentially the same as for the first specific embodiment, except with the axial securing of the stator being provided toward one side in the form of a lock washer that is separately mounted on the outer shaft of the double camshaft.

In addition, FIG. 2 illustrates a second specific embodiment of valve train unit 11 according to the present invention, which has essentially the same design and function as the first specific embodiment. Consequently, camshaft adjuster 1 also has essentially the same design. Double camshaft 3 also has essentially the same design. The features described for FIG. 1 thus apply to FIG. 2 as well. However, in a departure from FIG. 1, stop element 16 is now designed as a stop disk 41 that is separate from drive gearwheel 8 and from hydraulic medium supply bushing 38. This stop disk 41 is inserted into the axial area between drive gearwheel 8 and hydraulic medium supply bushing 38. Stop disk 41 is pressed with its radial inner side onto outer shaft 6 and is thus rotatably fixedly connected to same. Stop disk 41 is used as an axial stop for connecting element 5 as well as for drive gearwheel 8.

Figure 3:
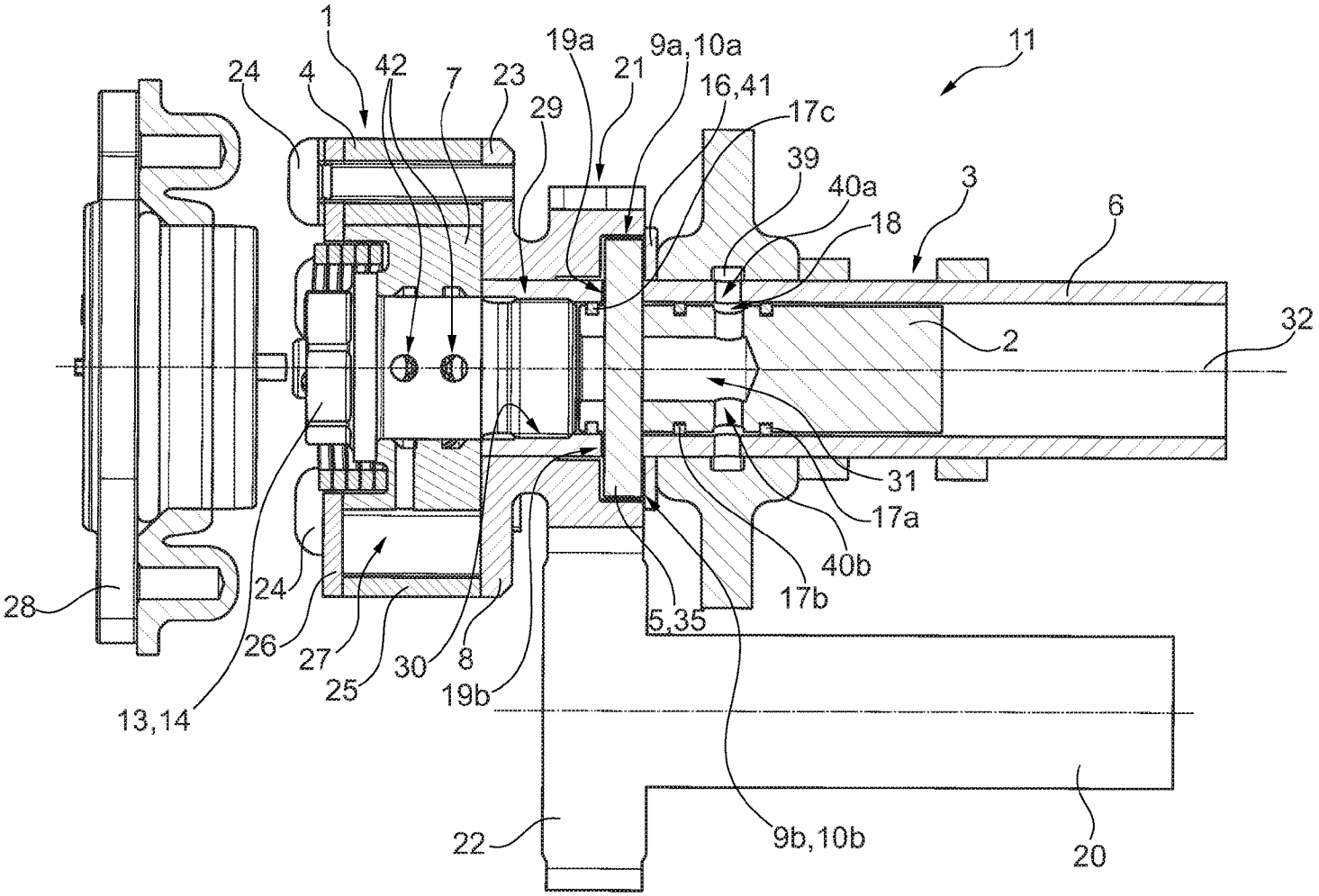
FIG. 3 shows another longitudinal sectional illustration of the valve train unit according to FIG. 3, except with the fastening means, designed as a central valve, not being illustrated in a sectional view.

This second specific embodiment is illustrated once more in FIG. 3, except that the outer circumferential side of central valve 13 is now particularly clearly apparent, on the circumferential side of which multiple hydraulic guide bores 42 are introduced, which in turn are hydraulically connected to respective working chambers 27 of camshaft adjuster 1. Drive shaft 20 is likewise illustrated here in a nonsectional view, not a sectional view.

Figure 4:
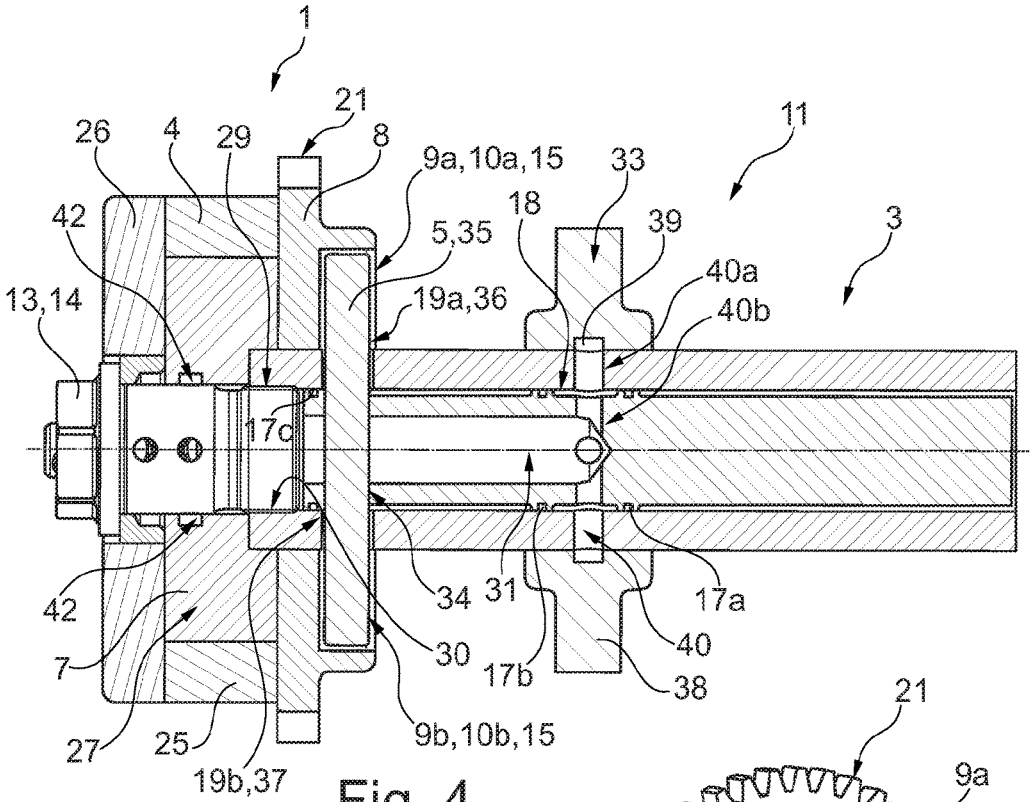
FIG. 4 shows a schematic longitudinal sectional illustration of a valve train unit according to the present invention, together with a camshaft adjuster according to the present invention, according to a third specific embodiment, in the section plane that extends along the rotation axis of the double camshaft, it being apparent in particular that the drive gearwheel of the stator has a more compact design in the axial direction.
Figure 5:
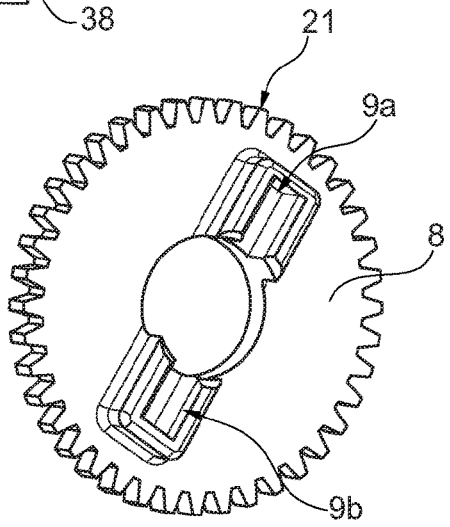
FIG. 5 shows an isometric illustration of the drive gearwheel of the stator inserted into the camshaft adjuster according to FIG. 4, the drive gearwheel being illustrated from a side in which the accommodation areas for the connecting element are formed.

In addition, FIG. 4 illustrates a third specific embodiment of valve train unit 11 according to the present invention, which once again in principle has the same design and function as the first specific embodiment. Therefore, once again only the differences from this first specific embodiment are discussed below. The illustration of drive shaft 20, adjustment actuator 28, and stop element 16 is omitted in FIG. 4 for the sake of clarity. Stator 4 has a slightly different design in this specific embodiment. Stator 4 has a more compact design in particular in the axial direction. This more compact design is implemented by the modified drive gearwheel 8. Drive gearwheel 8, which is also particularly clearly apparent by itself in FIG. 5, has an essentially disk-shaped design. External teeth 21 are formed on an outer side of the disk, which at the same time also forms flange section 23. Accommodation areas 9*a* and 9*b* are axially offset with respect to external teeth 21. The two grooves 10*a* and 10*b* are each formed in a thickened area which extends away from the disk-shaped base section of drive gearwheel 8 in the axial direction.

Figure 6:
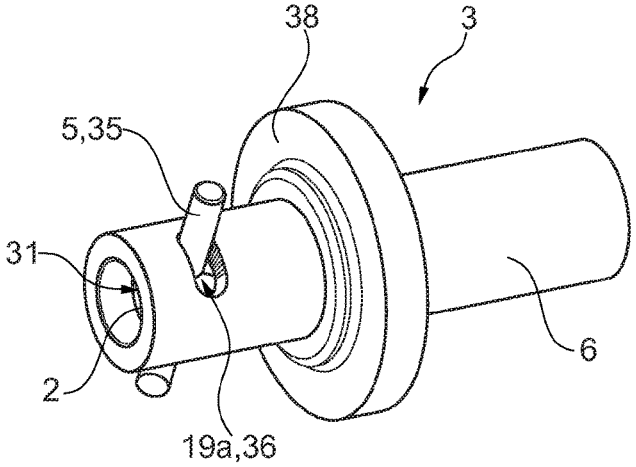
FIG. 6 shows an isometric illustration of a subassembly between the double camshaft, the connecting element, and a hydraulic medium supply bushing that is mounted on the outer circumferential side of the outer shaft, the subassembly being inserted into the valve train unit according to FIG. 4.

The accommodation of connecting element 5 in first through hole 19*a*, designed as an elongated hole, is also particularly clearly apparent in FIG. 6.

Figure 7:
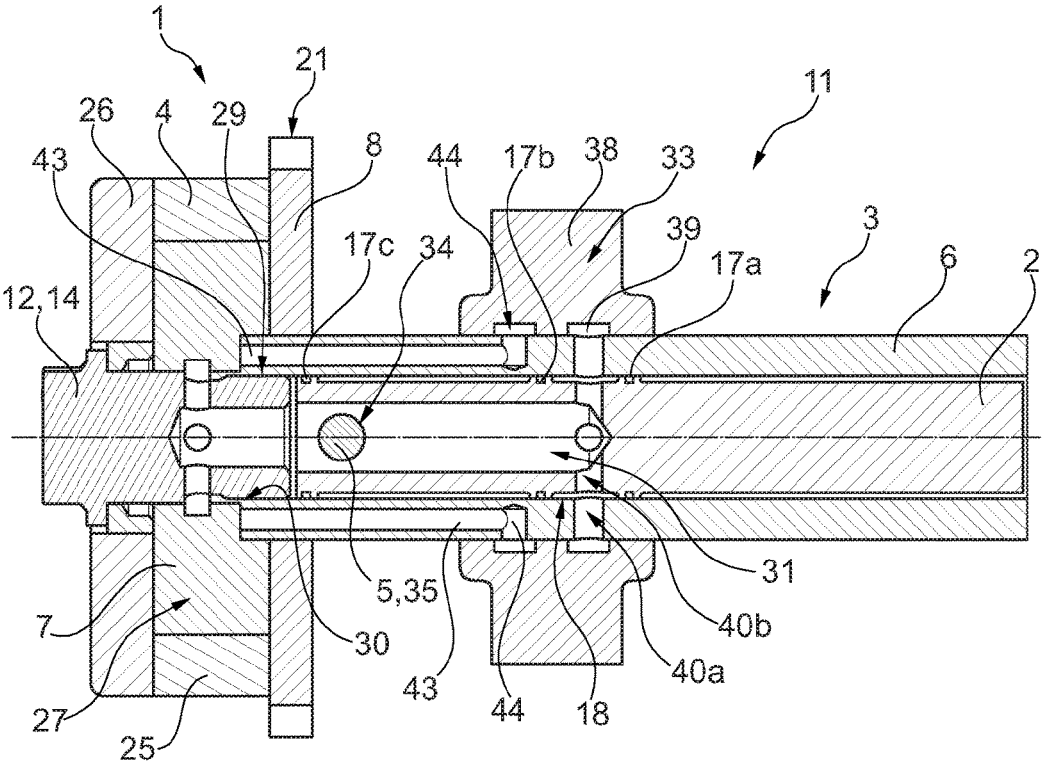
FIG. 7 shows a longitudinal sectional illustration of a further, fourth specific embodiment according to the present invention of the valve train unit, together with the camshaft adjuster, in the section plane extending along the rotation axis of the double camshaft (in comparison to FIG. 4, sectioned in a rotation by 90° about the rotation axis) it being apparent in particular that the fastening means is no longer designed as a central valve as in FIG. 4, but, rather, as a screw that is screwed into the outer shaft.
Figure 8:
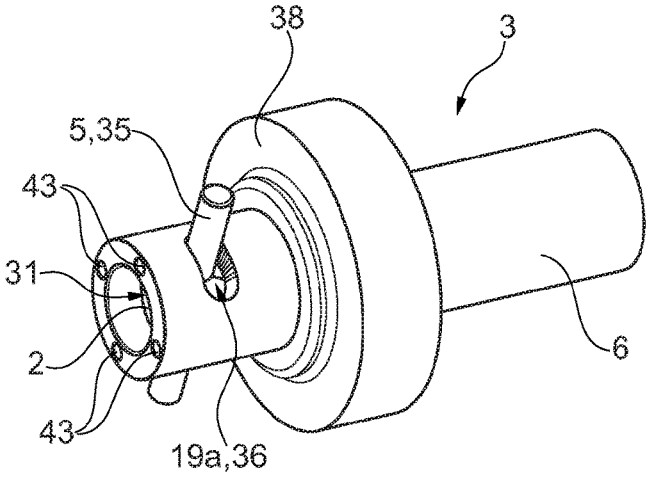
FIG. 8 shows an isometric illustration of a subassembly between the double camshaft, the connecting element, and a hydraulic medium supply bushing, as integrated into FIG. 7, the hydraulic medium discharge lines distributed along the circumference and introduced into the outer shaft on the front side being particularly clearly apparent.

Furthermore, FIG. 7 illustrates a fourth specific embodiment of valve train unit 11 according to the present invention, this specific embodiment once again having the same design as the third specific embodiment, and thus, as the first specific embodiment. However, compared to the third specific embodiment, fastening means 14 is now designed as a screw 12, not as a central valve 13. FIG. 7 illustrates camshaft adjuster 1 sectioned by 90° with respect to the section plane in FIG. 4, for which reason connecting element 5 is now illustrated in a section not in its longitudinal direction, but, rather, perpendicular thereto. It is also apparent in this illustration that hydraulic medium supply system 33 likewise has a slightly different design. In outer shaft 6, multiple axial channels 43 are in turn distributed along the circumference of outer shaft 6, as is particularly clearly apparent in FIG. 8. These axial channels 43 are introduced into outer shaft 6, extending in the axial direction, from a front side of outer shaft 6 facing rotor 7. Axial channels 43 open into rotor 7 in the axial direction. On an axial side facing away from rotor 7, axial channels 43 open into a guide channel 44 which is likewise formed on an inner circumferential side of hydraulic medium supply bushing 38.

In other words, unlike the approaches known thus far, stator 4 with its inner camshaft (inner shaft 2), and rotor 7 are coupled to the outer camshaft (outer shaft 6). The adjuster (camshaft adjuster 1) is fixedly screwed with a central valve 13 to an outer shaft 6. Stator 4 with its cover or its gearwheel (drive gearwheel 8) is coupled to inner camshaft 2 via a transverse pin (connecting element 5). Gearwheel 8 has two clearances (grooves 10*a* and 10*b*) introduced into both sides for accommodating pin 5. Clearances 10*a* and 10*b* are coordinated with pin 5 in such a way that no noise resulting from play is created in the operating state. If a disadvantageous connection tolerance should occur that could possibly result in jamming of adjuster 1, in the present invention tolerance compensation is now allowed at the bearing point, i.e., at gearwheel 8 on outer camshaft 6, and at the coupling site between gearwheel grooves 10*a* and 10*b* and pin 5, thus making the system movable. Outer camshaft 6 has elongated holes 19*a* and 19*b* at the location of pin 5, depending on the required adjustment angle [[2]].

In order for the oil transfer into central valve 13 to operate with preferably little leakage, at least three sealing rings (17*a* through 17*c*) are provided between the two camshafts 2 and 6. The sealing rings prevent the hydraulic medium/oil from being lost via the gap (space 18) between camshaft 3 and elongated holes 19*a* and 19*b*. The approach using the drive gearwheel is particularly robust. The axial bearing of outer camshaft 6 takes place via the front side of the gearwheel, i.e., the front side of gearwheel 8. The axial bearing of inner camshaft 2 may take place either via elongated holes 19*a* or 19*b*, pin 5 then coming into contact with outer camshaft 6, or with the aid of central valve screw 13, which is applied to the front side of inner camshaft 2; this second specific embodiment is not illustrated for the sake of clarity. The bearing of inner camshaft 2 toward another side takes place preferably with the aid of a disk/stop element 16, which due to the axial bearing of connecting element 5 thus also indirectly supports the inner shaft. Stop element 16 or stop disk 41 is preferably hardened and placed between the bearing (hydraulic medium supply bushing 38) and pin 5. By use of these approaches, it has been possible to implement a particularly simple design of the camshaft ends of the outer shaft and of the inner shaft (for example, to implement straight ends, for example, without expansions in diameter), thus avoiding fairly complicated manufacturing steps.

LIST OF REFERENCE NUMERALS

1 camshaft adjuster
2 inner shaft
3 double camshaft
4 stator
5 connecting element
6 outer shaft
7 rotor
8 drive gearwheel
9*a* first accommodation area
9*b* second accommodation area
10*a* first groove
10*b* second groove
11 valve train unit
12 screw
13 central valve
14 fastening means
15 accommodation space
16 stop element
17*a* first sealing element
17*b* second sealing element
17*c* third sealing element
18 space
19*a* first through hole
19*b* second through hole
20 drive shaft
21 external teeth
22 gearwheel
23 flange section

24 fastening means
25 stator base body
26 end cover
27 working chamber
28 adjustment actuator
29 external tooth section
30 internal tooth section
31 blind hole
32 rotation axis
33 hydraulic medium supply system
34 receiving hole
35 solid bolt
36 first circumferential side
37 second circumferential side
38 hydraulic medium supply bushing
39 supply channel
40*a* first supply borehole
40*b* second supply borehole
41 stop disk
42 hydraulic guide bore
43 axial channel
44 guide channel

What is claimed is:

1. A vane cell hydraulic camshaft adjuster comprising:

a stator configured for a rotatably fixed connection to an inner shaft of a double camshaft;

a connection element configured for a rotatably fixed accommodation of the inner shaft and being accommodated in the stator in a form-locked manner;

a rotor rotatable relative to the stator and configured for a rotatably fixed connection to an outer shaft of the double camshaft;

the connection element being accommodated with play in the stator in order to compensate for axial tolerances or relative tilting of the inner and outer shafts in an operating state of the camshaft adjuster.

2. The camshaft adjuster as recited in claim 1 wherein the connection element has a pin-shaped design.

3. The camshaft adjuster as recited in claim 1 wherein the connection element is accommodated in a drive gearwheel of the stator.

4. The camshaft adjuster as recited in claim 1 wherein the connection element is accommodated on two accommodation areas of the stator, the two accommodation areas being provided in a form of grooves.

5. The camshaft adjuster as recited in claim 4 wherein the connection element is a pin or bolt and the grooves include a first groove and a second groove, a first end of the pin or bolt being accommodated in the first groove and a second end of the pin or bolt being accommodated in the second groove.

6. The camshaft adjuster as recited in claim 5 wherein the first groove and the second groove are separated by a center hole passing through the stator.

7. The camshaft adjuster as recited in claim 1 wherein the connection element is accommodated with play in the stator in the radial direction or in the axial direction of the stator.

8. A valve train unit comprising:

the camshaft adjuster as recited in claim 1;

the double camshaft includes the outer shaft and the inner shaft situated radially within the outer shaft and rotatable relative to the outer shaft, the stator of the camshaft adjuster being connected to the inner shaft in the form-locked manner with the aid of the connection element for the rotatably fixed connection, and the rotor of the camshaft adjuster being rotatably fixedly connected to the outer shaft.

9. The valve train unit as recited in claim 8 wherein the rotor is rotatably fixedly pressed onto a front side of the outer shaft with the aid of a fastening means designed as a screw or as a central valve.

10. The valve train unit as recited in claim 8 wherein the connection element passes through the outer shaft and the inner shaft in the radial direction.

11. The valve train unit as recited in claim 8 wherein the connection element is accommodated with play in an axial accommodation space, the accommodation space being delimited toward a first axial side by the stator, and being delimited with respect to a second axial side opposite from the first side with the aid of a stop element fastened to the outer shaft.

12. The valve train unit as recited in claim 11 wherein the axial accommodation space includes a first accommodation area and a second accommodation area, a first end area of the connecting element being in the first accommodation area with play in an axial direction, a radial direction, and a circumferential direction of the camshaft adjuster, a second end area of the connecting element being in the second accommodation area with play in the axial direction, the radial direction, and the circumferential direction of the camshaft adjuster.

13. The valve train unit as recited in claim 8 further comprising multiple sealing elements situated in a radial space between the inner shaft and the outer shaft in order to seal off the interior of the outer shaft via two through holes, the connection element protruding through the through holes.

14. The valve train unit as recited in claim 1 wherein the stator includes a stator base body surrounding the rotor, an end cover fixed to an axial front side of the stator base body and a drive gearwheel fixed to stator base body opposite of the end cover.

15. The camshaft adjuster as recited in claim 14 wherein the connection element is accommodated in the drive gearwheel.

16. The camshaft adjuster as recited in claim 14 wherein the drive gearwheel includes external teeth and a disk-shaped flange section axially offset with respect to the external teeth, the connection element being accommodated in the disk-shaped flange section.

17. The camshaft adjuster as recited in claim 14 further comprising a screw or a central valve passing axially through the rotor, the connecting element being axially spaced from an end of the screw or central valve facing away from the end cover.

* * * * *